US005252040A

United States Patent [19]

Vandergriff et al.

[11] Patent Number: 5,252,040

[45] Date of Patent: Oct. 12, 1993

[54] FLUID TRANSPORTING APPARATUS USING REFLEXIVE HYDRAULIC ACTUATION

[76] Inventors: William L. Vandergriff, 7780 E. Mary, Tucson, Ariz. 85730; Donald W. Cole, 601 Crockett, Odessa, Tex. 79762

[21] Appl. No.: 796,866

[22] Filed: Nov. 25, 1991

[51] Int. Cl.[5] ..... F04B 9/08; F04B 43/10

[52] U.S. Cl. ..... 417/378; 417/394

[58] Field of Search ..... 417/378, 388, 394; 60/584, 592

[56] References Cited

U.S. PATENT DOCUMENTS

| | | | |
|---|---|---|---|
| 2,630,761 | 3/1953 | Mashinter | 417/394 |
| 2,630,762 | 3/1953 | Mashinter | 417/394 |
| 4,297,087 | 10/1981 | Akkerman | 417/378 |
| 4,616,981 | 10/1986 | Simmons et al. | 417/378 |

FOREIGN PATENT DOCUMENTS

| | | | |
|---|---|---|---|
| 0128684 | 10/1980 | Japan | 417/394 |
| 0941669 | 7/1982 | U.S.S.R. | 417/394 |
| 2079859 | 1/1982 | United Kingdom | 417/394 |

*Primary Examiner*—Richard A. Bertsch
*Assistant Examiner*—Alfred Basichas

[57] ABSTRACT

An apparatus for transporting fluids from a reservoir or source to a remote point of use wherein a multiple-chambered slave unit, when hydraulically actuated through a single conduit communicating with a distant master pressure-generating unit, will upon relief of the actuating pressure, contribute to the conduit, fluid aspirated from the source in addition to the original volume of actuating fluid.

1 Claim, 1 Drawing Sheet

FLUID TRANSPORTING APPARATUS USING REFLEXIVE HYDRAULIC ACTUATION

1. TECHNICAL FIELD

The invention relates to an apparatus for transporting fluids from a source or reservoir to a point of use or another reservoir and more particularly to a reflexive hydraulic fluid transport system employing a single conduit for both the actuation of a remote aspiration unit at the source end and conduction of the aspirated fluid to a remote escape point or point of use.

2. DESCRIPTION OF RELATED ART

Means employed to the desired end of transporting fluid from a source to a point of use are myriad and date from earliest history. Those most related to the present invention employ at the source of fluid or rotary or reciprocating pump powered mechanically by thrust-tension rods or a torque shaft enclosed within the single conduit which is characteristic of the present invention. Electrically powered pumps also employ a single conduit, but here the source of power is wiring external to the conduit and, therefore, analogous to pneumatic and hydraulic actuators requiring additional and external secondary conductors. A fluid transporting apparatus is needed that eliminates the hazard of immersed electrical systems, that reduces the cost and complexity of multiple-conduit systems and that unlike rod and shaft powered pumps may operate around sharp bends or through reduced passages such as those of heat exchangers.

SUMMARY OF THE INVENTION

The apparatus of the present invention corresponds most nearly to the slave cylinder of a closed-circuit master cylinder-slave cylinder hydraulic braking system commonly employed in automobiles. In such closed systems great care is exercised to prevent leakage and consequent reduction of the fixed volume of actuating fluid; however, where leakage might occur because of seal wear or imperfect connections, provisions can be and usually are made to replace the exact volume of the escaped fluid from a reserve supply from which the master cylinder draws when and only when the master cylinder finds the slave cylinder has not returned to it the full amount of fluid the master cylinder has delivered to the slave cylinder.

In reflexive hydraulic fluid transport, as the term is applied to the present invention, fluid escape deliberately permitted at a point of use is replenished at the actuated end of the hydraulic circuit rather then at the actuating end, and in this respect the master-slave relationship, typical of automotive employment, is reversed.

By reason of this role reversal and in consideration of the fact that there are many common means of applying intermittent actuating force at the actuating end of a master-slave hydraulic circuit, the substance of this invention is confined to the actuated element of the circuit and the essential principle of this actuated element which is that of replacing from an outside source fluid which the actuated element has contributed to the hydraulic circuit for delivery to a distant point of use.

Illustrated in FIGS. 1A and 1B, fluid aspirated during a relaxation stroke is transferred to an intermediate chamber during the next actuating stroke, and from the intermediate chamber it is contributed to the common content of the circuit during the following relaxation stroke.

It should be mentioned that the actuated element, the apparatus of the invention, may be called upon to return to its relaxed state against a variety of pressure conditions, and it can be adapted to these by providing it with return springs or elastic counter force means of varying strength. For example, if it is transferring fuel from one aircraft tank to another on the same level, reflexive force may be modest. If it is supplying the boiler of a steam engine, reflexive requirements will be much higher. Where it is elevating water from a subterranean source to the surface, for each foot of lift it must provide in excess of 0.433 pounds per square inch lifting pressure, plus any additional pressure required by a standpipe or pneudraulic accumulator at the point of use.

The drawings following are diagrammatic for the reason that a plethora of materials, assembly methods and standard accessories may be employed without departing from the scope of the invention. For example, springs or elastomeric materials may provide reflexive force, and obviously, captive gas or compressible fluids as illustrated in FIGS. 1A and 1B (gas bearing emulsions) may serve the same purpose.

Several forms of uni-directional valves are usable, and ball uni-directional valves without details of assumed practice such as cages and seating springs, are illustrated in FIGS. 1A and 1B, as representative.

DESCRIPTION OF THE PREFERRED EMBODIMENTS

Figure 1A:
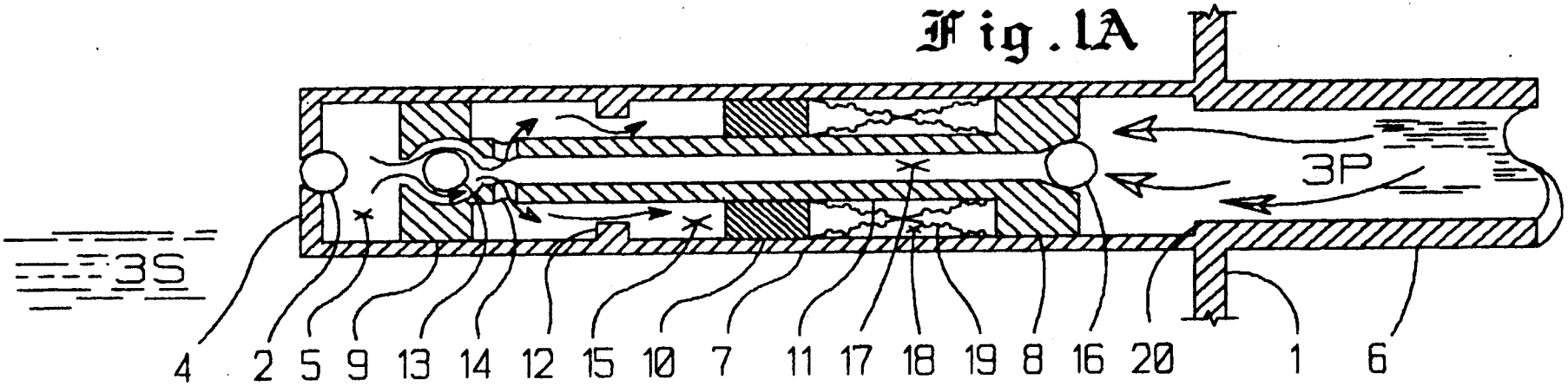
FIGS. 1A and 1B illustrate a form of the apparatus of the invention where an essentially rigid tubular structure is provided with non-rigid, movable, mechanically coupled partitions, illustrated as piston, dividing the tubular cavity into chambers one of which contains a compressible, elastic element capable of forcefully returning the mechanically coupled and otherwise movable partitions to their original resting state, upon relief of actuating pressure.
Figure 1B:
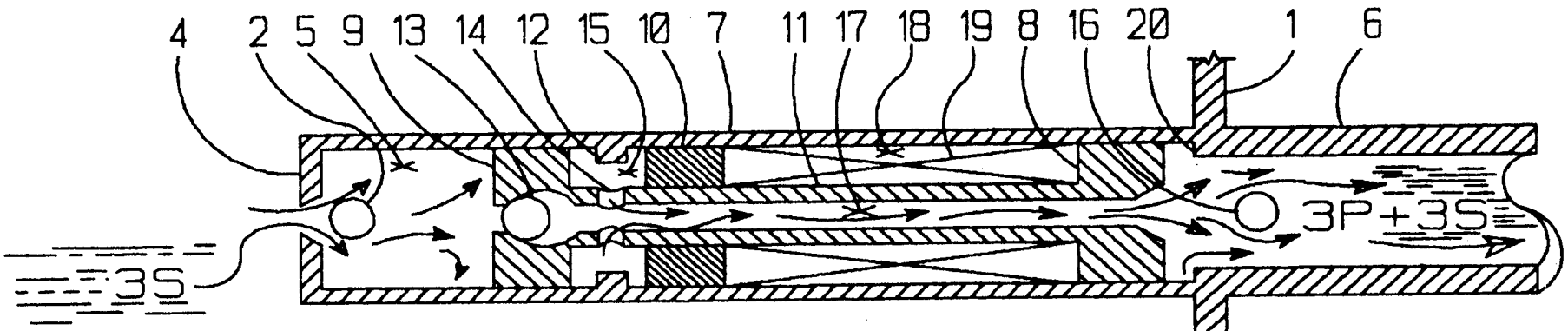

A form of the apparatus of the present invention is described in reference to FIGS. 1A and 1B, the apparatus of FIGS. 1A and 1B is positioned in a fluid reservoir (1) where its uni-directional intake valve (2) must be immersed in the supply fluid (3S). The uni-directional intake valve (2) is centrally located in the closure plate (4) of a cylinder (7) whose opposite end is joined in a fluid-tight manner to the conduit (6). Within the cylinder (7), a primary piston (8) is mechanically attached to a secondary piston (9) by means of a hollow connecting shaft (11). A tertiary piston (10) rests upon a shoulder (12) mechanically attached to the inner bore of the cylinder (7). A compressible fluid (19) drives the primary piston (8) and the tertiary piston (10) apart, ergo to their normal or resting position against the shoulder (20) and the shoulder (12) respectively. A uni-directional valve (13) permits entry of pressurized fluid (3S) from the aspiration chamber (5) into the bore of the connecting shaft (11) and through the vents (14) into the accumulation chamber (15) during the actuation stroke. A second uni-directional valve (16) at the opposite end of the bore of connecting shaft (11) prevents entry of pressurized fluid (3P) from the conduit (6) during the actuation stroke. A compressible chamber (18) is isolated from fluid invasion by a fluid-tight, slidable, engagement of the primary piston (8) and the tertiary piston (10) with their respective interior cylinder (7) walls.

Operation of the apparatus is described with reference to FIG. 1A. When actuating hydraulic pressure is applied to the fluid (3P) within the conduit (6) by a pressure generating means at a remotely located terminus of the conduit (6), the uni-directional valve (16) seats, and the primary piston (8) and the secondary piston (9) are forced to travel against the pressure of the compressible fluid (19) toward the closure plate (4) end of the cylinder (7) through the intermediate of the connecting shaft (11). The uni-directional intake valve (2) seats and the uni-directional valve (13) unseats, permitting supply fluid (3S) from the aspiration chamber (5) to enter the bore (17) of the connecting shaft (11) from which the supply fluid (3S) discharges through the vents (14) into the accumulation chamber (15).

The accumulation chamber (15) is of a volumetric capacity inferior to that of the aspiration chamber (5) by reason of the intrusion of the connecting shaft (11); therefore, the tertiary piston (10) must yield against the force of the compressible fluid (19) in order to increase the volume of the accumulation chamber (15) to equal that of the aspiration chamber (5). Referring to FIG. 1B. Upon withdrawal of the actuating pressure within the conduit (6), the compressible fluid (19) expands and forces the primary piston (8) and tertiary piston (10) back to their resting positions with consequent reduction of volume of the accumulation chamber (15), driving its contents of the supply fluid (3S) back through the vents (14) and into the bore (17) where it is restrained by the seated uni-directional valve (13) and liberated into the conduit (6) by the unseated uni-directional valve (16) where it joins the pressurizing fluid (3P) to create a surplus content of fluid in the conduit (6). Simultaneously, the aspiration chamber (5) increases to its original volume and refills with fluid (3S) from the reservoir (1) in preparation for the next cycle.

While representative embodiments of the invention have been described as shown, those versed in the art will recognize that alterations and modifications, some of which have been suggested, may be made thereto without departing from the spirit and scope of the invention.

We claim:

1. A pumping apparatus for transporting fluids from a reservoir to a point of use, comprising:

a housing defining a cylinder with a first end and a second end, wherein said first end is attached to a fluid pressure source and said second end defines an outlet;

a piston assembly including a top piston having an inner and outer face for sliding sealed motion along said cylinder, wherein said top piston and said bottom piston are connected by a hollow shaft;

a shoulder is defined on the inside of said cylinder between said top piston and said bottom piston for restricting the motion of said piston assembly;

a spring means and a tertiary piston are positioned between said top piston and said shoulder acting to return said piston assembly to said first end of said cylinder, wherein said spring means defines a spring chamber between said tertiary piston and said top piston, and an accumulation chamber is defined between said shoulder and said second piston;

a first vent means defined by said cylinder acting to accomodate fluid flow into and out of said spring chamber, and a second vent means on said hollow shaft acting to accomodate fluid flow into and out of said accumulation chamber;

check valve means positioned in said top piston, said bottom piston and said outlet, acting to allow for uni-directional flow.

* * * * *